US012644675B2

(12) United States Patent
Nerheim et al.

(10) Patent No.: US 12,644,675 B2
(45) Date of Patent: Jun. 2, 2026

(54) ACCESSORY DEVICE FOR A CONDUCTED ELECTRICAL WEAPON

(71) Applicant: Axon Enterprise, Inc., Scottsdale, AZ (US)

(72) Inventors: Magne Nerheim, Paradise Valley, AZ (US); Mark Eastwood, Scottsdale, AZ (US); Michael Gish, Phoenix, AZ (US)

(73) Assignee: AXON ENTERPRISE, INC., Scottsdale, AZ (US)

( * ) Notice: Subject to any disclaimer, the term of this patent is extended or adjusted under 35 U.S.C. 154(b) by 38 days.

(21) Appl. No.: 18/689,363

(22) PCT Filed: Sep. 9, 2022

(86) PCT No.: PCT/US2022/043078
§ 371 (c)(1),
(2) Date: Mar. 5, 2024

(87) PCT Pub. No.: WO2023/196006
PCT Pub. Date: Oct. 12, 2023

(65) Prior Publication Data

US 2024/0369328 A1 Nov. 7, 2024

Related U.S. Application Data

(60) Provisional application No. 63/242,607, filed on Sep. 10, 2021.

(51) Int. Cl.
*F41H 13/00* (2006.01)
*F41H 5/08* (2006.01)

(52) U.S. Cl.
CPC ..... *F41H 13/0018* (2013.01); *F41H 5/08* (2013.01)

(58) Field of Classification Search
CPC ..... F41B 15/04; F41H 5/08; F41H 13/0018; F41H 13/0025
(Continued)

(56) References Cited

U.S. PATENT DOCUMENTS 7,302,880 B1 12/2007 Elasic
2011/0002077 A1* 1/2011 Brundula ..... F41H 13/0025 361/232
(Continued)

FOREIGN PATENT DOCUMENTS

JP 2013117326 A 6/2013
KR 20-0493556 Y1 4/2021
(Continued)

OTHER PUBLICATIONS

European Patent Office, Extended European Search Report for European Application No. 22936700.8, mailed Jul. 24, 2025.
(Continued)

*Primary Examiner* — Kevin J Comber
(74) *Attorney, Agent, or Firm* — Justin Powley

(57) ABSTRACT

An accessory device may be configured to output an electrical signal from a conducted electrical weapon ("CEW"). An accessory device may include a conducted energy shield. A conducted energy shield may include a shield body having a receiving unit for removably receiving a CEW that is used to provide an electrical current to one or more discharge rails disposed along a forward facing surface of the shield body and configured to deliver a high voltage current to an object coming into contact with the discharge rails. Once the CEW is removed from the receiving unit the shield body is unable to generate an electrical current across the discharge rails.

20 Claims, 7 Drawing Sheets

(58) Field of Classification Search
USPC ..... 361/232
See application file for complete search history.

(56) References Cited

U.S. PATENT DOCUMENTS

| | | | | |
|---|---|---|---|---|
| 2011/0013337 | A1 | 1/2011 | Brown | |
| 2014/0025328 | A1 | 1/2014 | Burns et al. | |
| 2018/0128578 | A1 | 5/2018 | Huggins et al. | |
| 2020/0109925 | A1* | 4/2020 | Goodchild | F41H 13/0031 |
| 2021/0080231 | A1 | 3/2021 | Nerheim | |
| 2024/0060743 | A1 | 2/2024 | Kern | |

FOREIGN PATENT DOCUMENTS

| | | | | |
|---|---|---|---|---|
| WO | 20060071370 | A1 | 7/2006 | |
| WO | WO-2006071370 | A1 * | 7/2006 | F41H 13/0018 |

OTHER PUBLICATIONS

Korean Intellectual Property Office, Preliminary Report on Patentability for International Application No. PCT/US22/43078 mailed Mar. 5, 2024.

Korean Intellectual Property Office, International Search Report for International Application No. PCT/US2022/043078 mailed Nov. 14, 2023.

* cited by examiner

ACCESSORY DEVICE FOR A CONDUCTED ELECTRICAL WEAPON

BACKGROUND OF THE TECHNOLOGY

Shields and batons are used by some first responders when responding to large crowds as a tool to both protect the first responder and help control the crowd. For example, a group of first responders each possessing a shield may stand side-by-side and set their shields edge to edge to form a barrier that can be used to push a crowd backwards or create a larger protective barrier. These shields are typically passive in that they are not designed for primary use as an offensive weapon.

SUMMARY OF THE TECHNOLOGY

A conducted energy shield according to various aspects of the present technology may include a shield body having a receiving unit for removably receiving a conducted electrical weapon (CEW) that is used to provide a neuro-muscular incapacitating electrical current to one or more discharge rails disposed along a forward facing surface of the shield body and configured to deliver a high voltage current to an object coming into contact with the discharge rails. Once the CEW is removed from the receiving unit the shield body is unable to generate an electrical current across the discharge rails.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Figure 1:
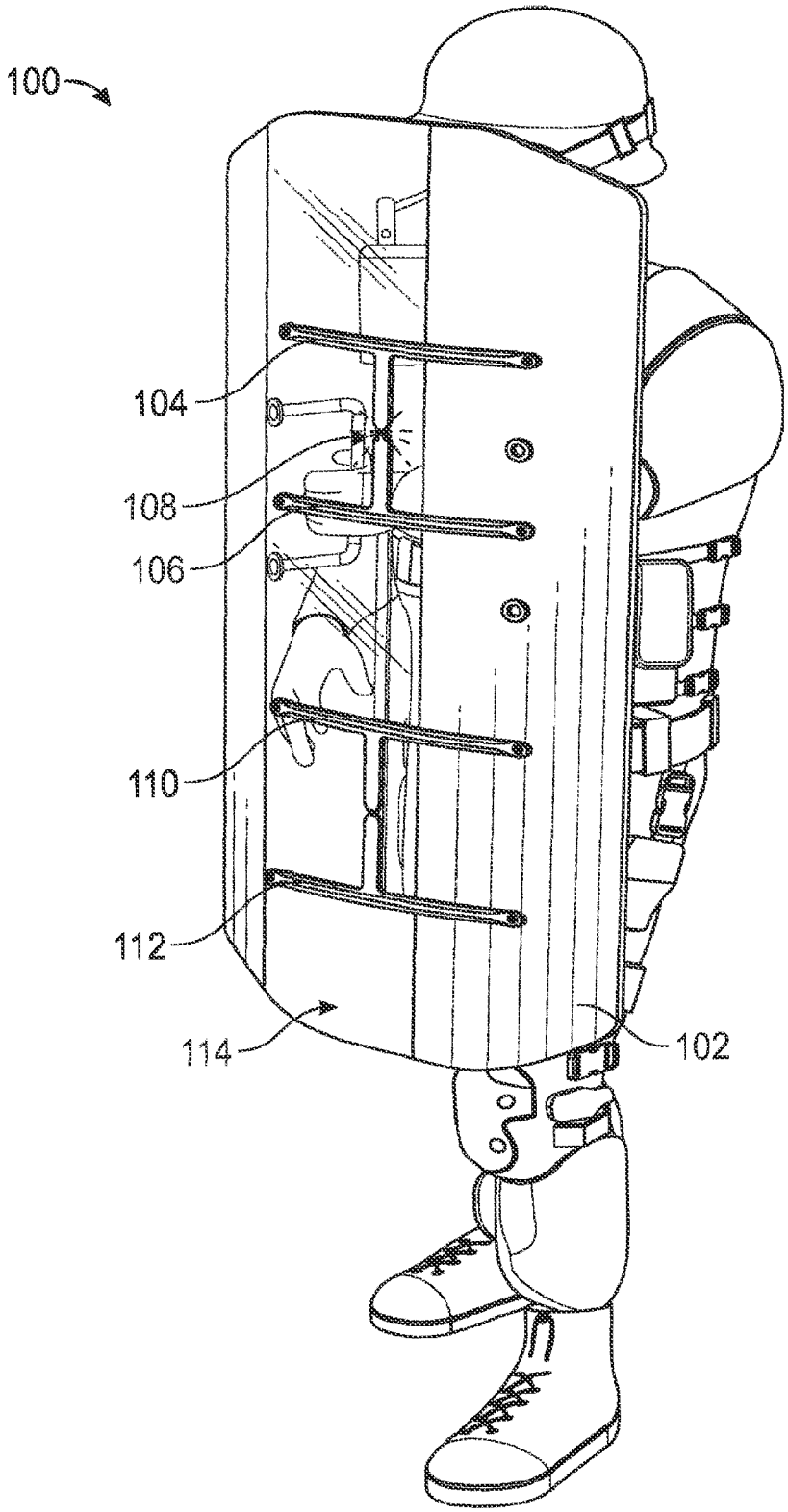
FIG. 1 representatively illustrates a partial see through view of a conducted energy shield in accordance with an exemplary embodiment of the present technology.
Figure 2:
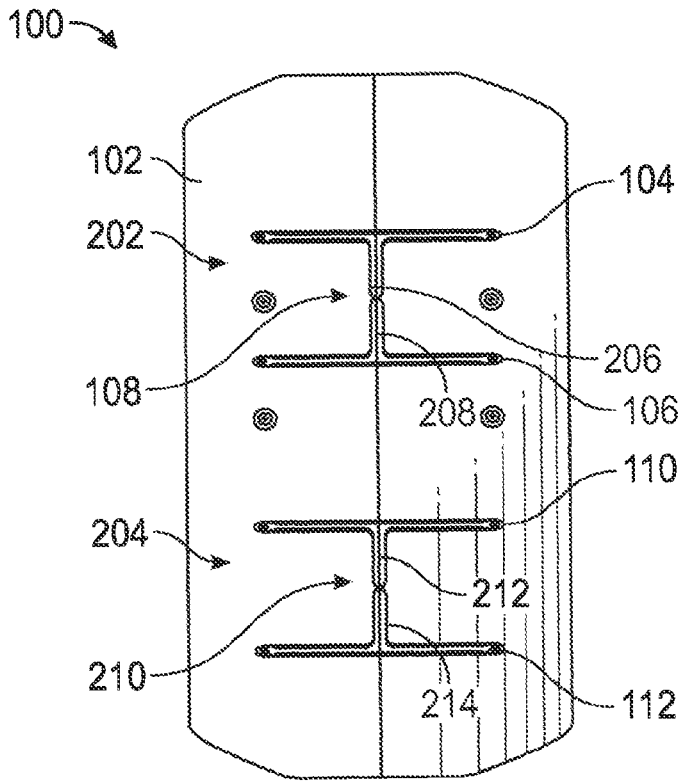
FIG. 2 representatively illustrates a front view of the conducted energy shield in accordance with an exemplary embodiment of the present technology.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various types of power generating and power storage systems, electrical circuits, and conducted energy systems, which may carry out a variety of operations. In addition, the technology described is merely one exemplary application for the invention. Further, the present technology may employ any number of conventional techniques for generating and storing electricity, conducting high voltage releases of energy, and managing power requirements.

Methods and apparatus for a conducted energy shield according to various aspects of the present technology may operate in conjunction with any type of conducted electrical weapon (CEW), power generation system, or electrical discharge system. Various representative implementations of the present technology may be applied to any system for shielding users from other persons, providing non-lethal or less-lethal protection system, crowd control systems, and/or the general storage of electrical power.

Referring to FIGS. 1, 2, 8, and 9, the conducted energy shield 100 (e.g., conducted electrical shield, etc.) may comprise a shield body 102, a first pair 202 of discharge rails 104, 106 disposed on a forward facing surface 114 of the shield body 102, and/or an arc display device 108 also disposed on the forward facing surface 114 of the shield body 102. In some embodiments, a second pair 204 of discharge rails 110, 112 and/or a second arc display 210 may further be disposed on the forward facing surface 114 of the shield body 102 below the first pair 202 of discharge rails 104, 106. With reference now to FIGS. 3-7, 10, and 11, a pair of handles 304 and a CEW bay 308 for a CEW 310 may be disposed on a rear facing surface 302 of the shield body 102. An electrical connection 602 (e.g., an electrical circuit, etc.) may connect the CEW bay 308 to the first pair of discharge rails 104, 106 and/or second pair of discharge rails 110, 112 so that the conducted energy shield 100 may be powered by the CEW 310 when the weapon is positioned in the CEW bay 308.

The shield body 102 may comprise any suitable size or shape configured to provide protection to a user in a given environment. For example, in some embodiments, the shield body 102 may comprise a concave shape (e.g., the forward facing surface 114 may comprise a concave shape relative to the rear facing surface 302). In other embodiments, the shield body 102 may comprise a convex shape e.g., the forward facing surface 114 may comprise a convex shape relative to the rear facing surface 302).

The shield body 102 may be sized and shaped to at least partially protect a body of the user. For example, the shield body 102 may comprise a height greater than a width of the shield body 102. The shield body 102 may comprise a height of about 3 feet (0.91 meters), about 4 feet (1.22 meters), about 5 feet (1.52 meters), about 6 feet (1.83 meters), and/or any other suitable height (wherein "about" as used in this context refers only to +/−6 inches (15.24 centimeters)). The shield body 102 may comprise a width of 1 foot (0.30 meters), about 2 feet (0.61 meters), about 3 feet (0.91 meters), and/or any other suitable width (wherein "about" as used in this context refers only to +/−6 inches (15.24 centimeters)).

The shield body 102 may be sized and shaped to at least partially protect a body part of the user. For example, the shield body 102 may comprise an arm guard configured to be worn on the forearm of a user. In that respect, the shield body 102 may comprise a width greater than a height of the shield body 102. The shield body 102 may comprise a height of about 6 inches (15.24 centimeters), about 1 foot (0.30 meters), about 2 feet (0.61 meters), and/or any other suitable height (wherein "about" as used in this context refers only to +/−3 inches (7.62 centimeters)). The shield body 102 may comprise a width of about 1 foot (0.30 meters), about 2 feet (0.61 meters), about 3 feet (0.91 meters), and/or any other suitable width (wherein "about" as used in this context refers only to +/−6 inches (15.24 centimeters)).

The shield body 102 may be made from various materials such as wood, metal, composites, polymers, and the like that are adapted to provide resistance or protections against impact forces. The shield body 102 may be formed as a rigid body though some ability to flex under certain types of loading may be acceptable. At least a portion of the shield body 102 may also be transparent to allow a user to see through the shield body 102 while covering their face.

Figure 3:
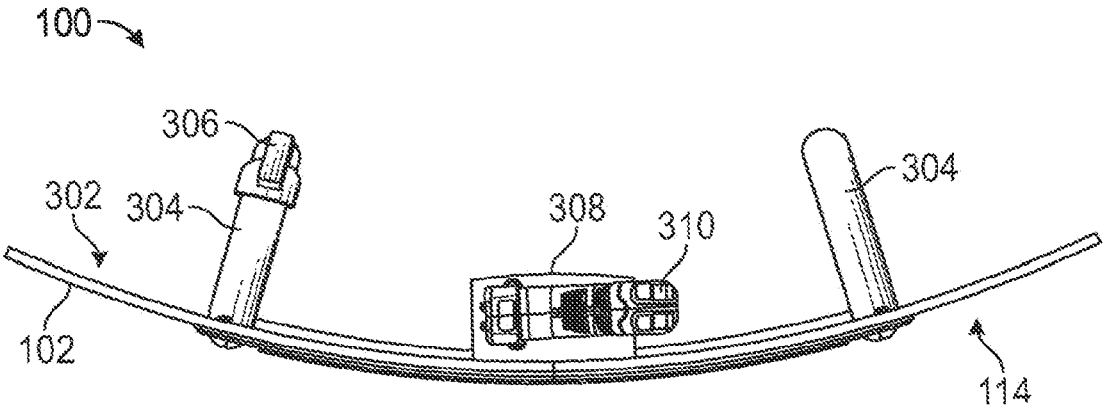
FIG. 3 representatively illustrates a top view of the conducted energy shield in accordance with an exemplary embodiment of the present technology.
Figure 7:
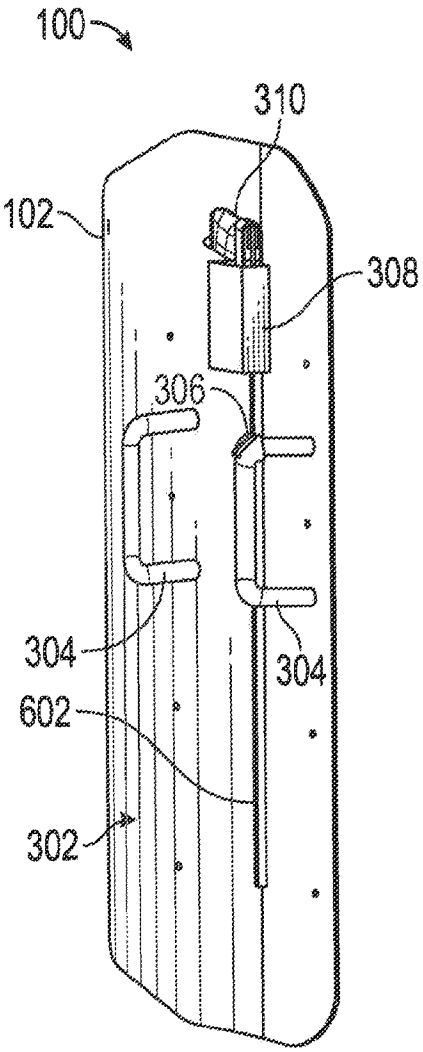
FIG. 7 representatively illustrates a right rear perspective view of the conducted energy shield in accordance with an exemplary embodiment of the present technology.
Figure 6:
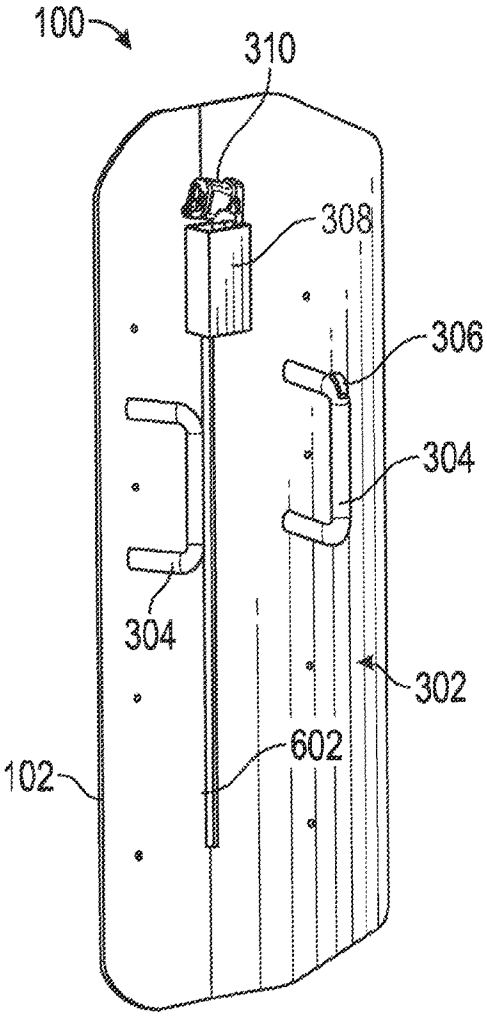
FIG. 6 representatively illustrates a left rear perspective view of the conducted energy shield in accordance with an exemplary embodiment of the present technology.
Figure 5:
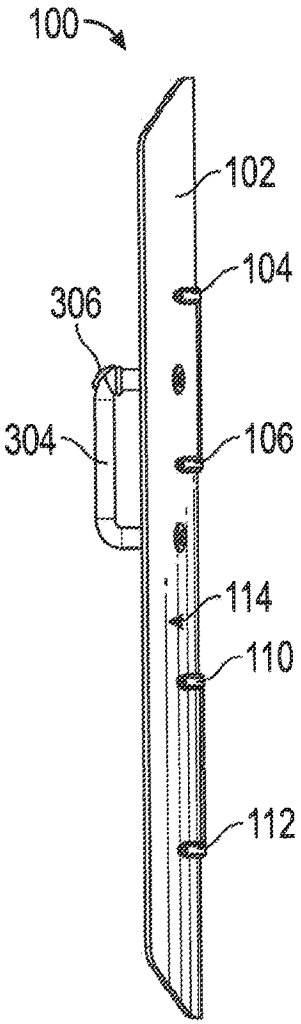
FIG. 5 representatively illustrates a right side view of the conducted energy shield in accordance with an exemplary embodiment of the present technology.
Figure 4:
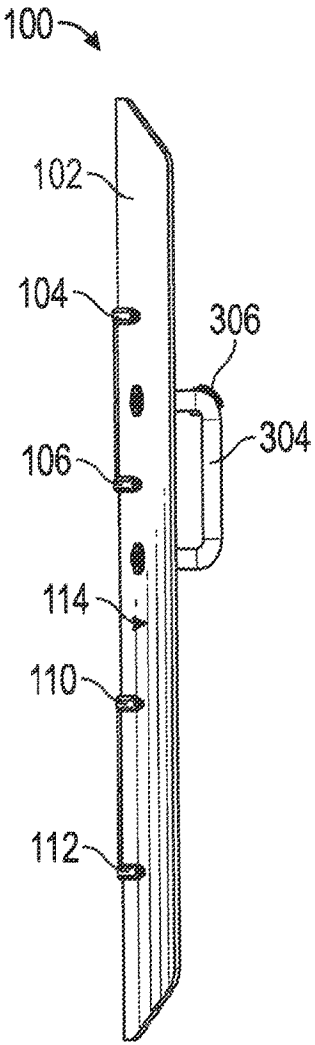
FIG. 4 representatively illustrates a left side view of the conducted energy shield in accordance with an exemplary embodiment of the present technology.
Figure 8:
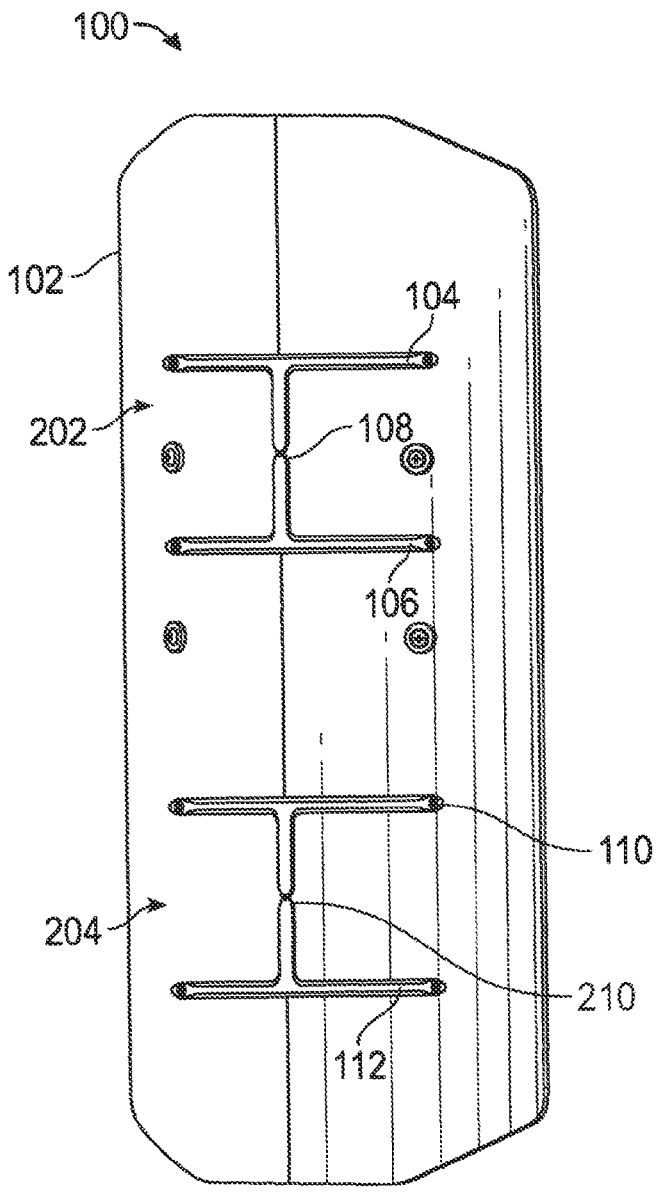
FIG. 8 representatively illustrates a front perspective view of the conducted energy shield in accordance with an exemplary embodiment of the present technology.
Figure 9:
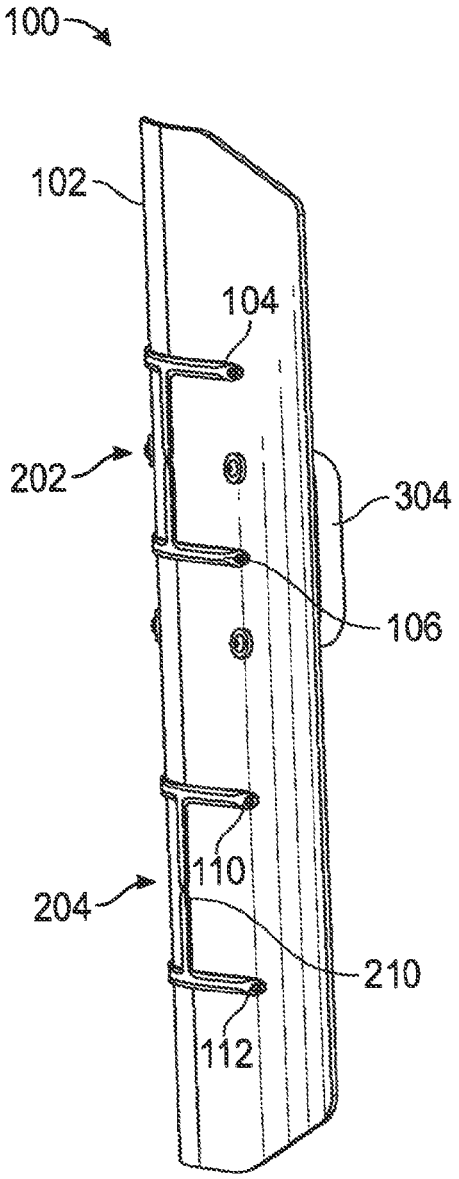
FIG. 9 representatively illustrates a side perspective view of the conducted energy shield in accordance with an exemplary embodiment of the present technology.
Figure 10:
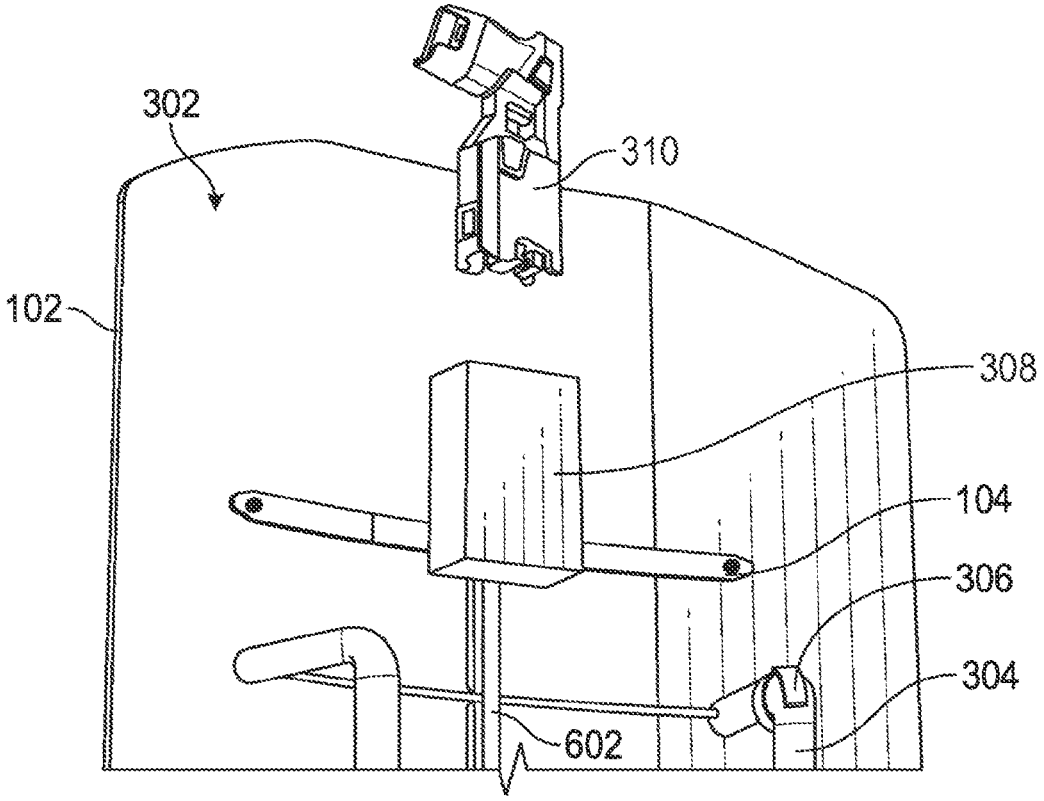
FIG. 10 representatively illustrates a receiving unit in accordance with an exemplary embodiment of the present technology.
Figure 11:
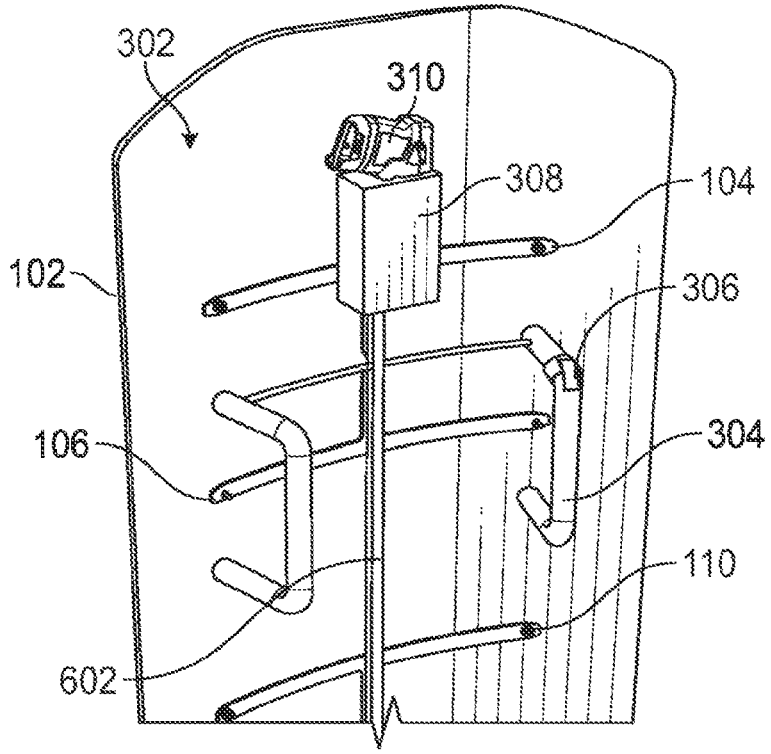
FIG. 11 representatively illustrates a wiring conduit for the conducted energy shield in accordance with an exemplary embodiment of the present technology.
Figure 12:
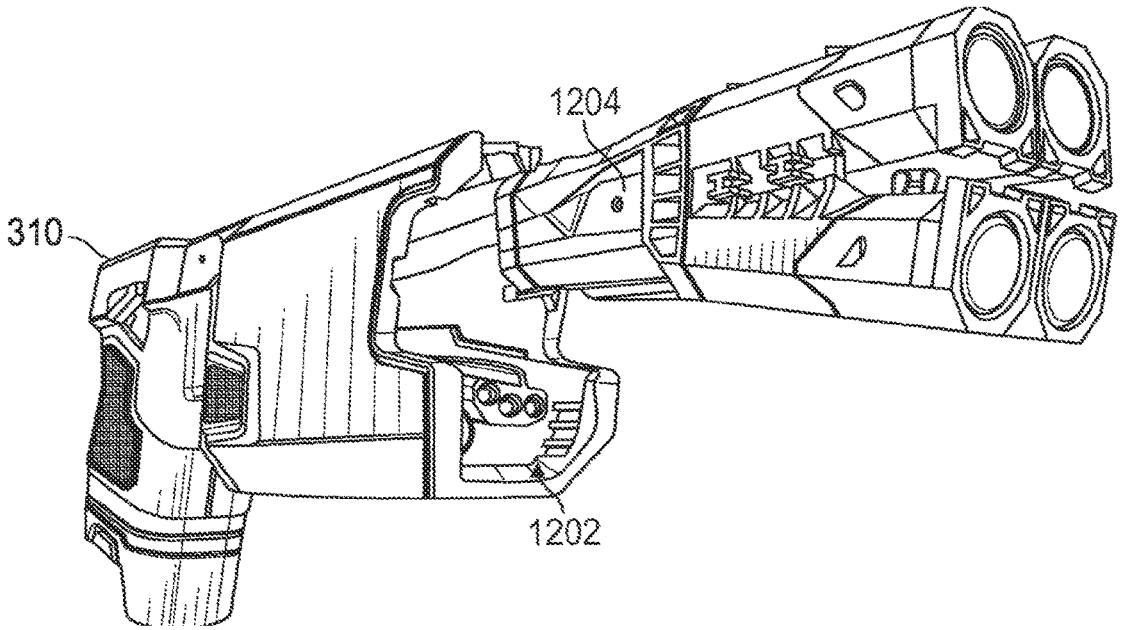
FIG. 12 representatively illustrates a receiving bay of a conducted electrical weapon and a cartridge in accordance with an exemplary embodiment of the present technology.
Figure 13:
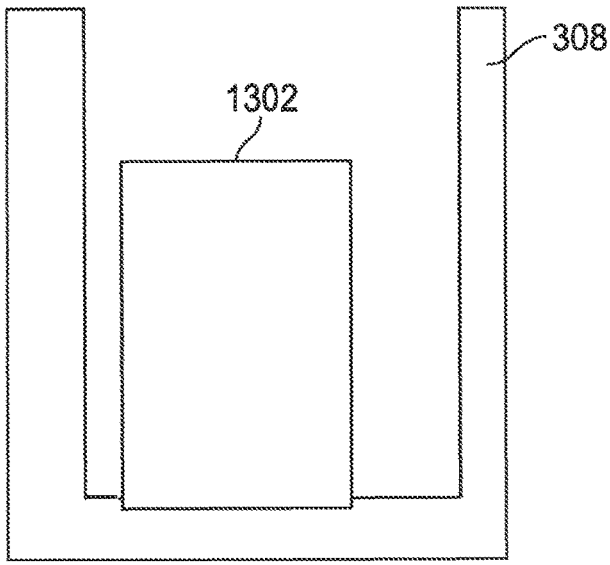
FIG. 13 representatively illustrates a partial cutaway view of the receiving unit in accordance with an exemplary embodiment of the present technology.
Figure 14:
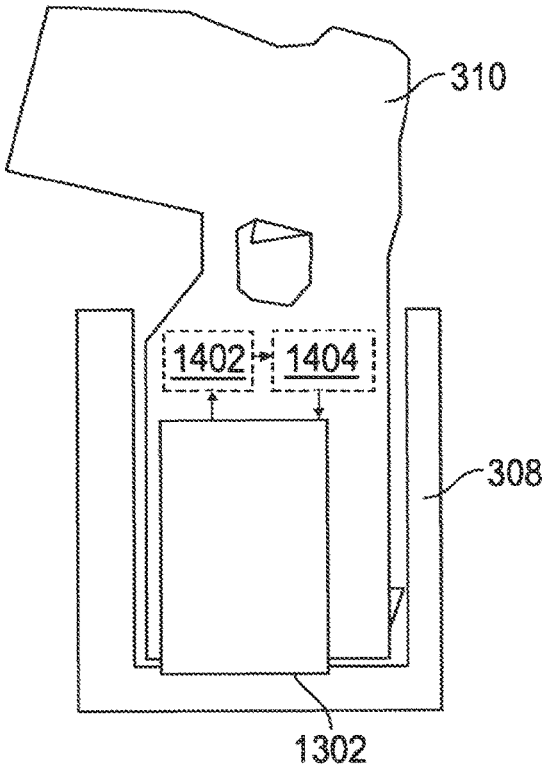
FIG. 14 representatively illustrates a partial cutaway view of the receiving unit docked with a conducted electrical weapon in accordance with an exemplary embodiment of the present technology.

Referring now to FIGS. 3-5, in one embodiment the shield body 102 may comprise a rigid polycarbonate material having a curved concave surface relative to the rear facing surface 302 with a width between about 18 inches (45.72 centimeters) and about 30 inches (76.2 centimeters) and a height of between about 24 inches (60.96 centimeters) and about 60 inches (152.4 centimeters) (wherein "about" as used in this context refers only to +/−6 inches (15.24 centimeters)). The polycarbonate material may be configured to act as an electrical insulator to prevent any electrical current from flowing to undesired locations on the shield body 102.

In various embodiments, a conducted energy shield may comprise any suitable number of discharge rails. For example, a conducted energy shield may comprise a plurality of discharge rails including a first discharge rail and a second discharge rail. As a further example, a conducted energy shield may comprise a first discharge rail, a second discharge rail, a third discharge rail, and a fourth discharge rail. As a further example, a quantity of discharge rails may be based on capabilities of the CEW bay and/or the CEW configured for insertion within the CEW bay, as discussed further herein. The quantity of discharge rails may be based on a number of the CEW is capable of receiving and/or a number of cartridge interfaces disposed within the CEW bay. For example, a conducted energy shield may comprise a pair of discharge rails for each cartridge the CEW is capable of receiving and/or for each number of cartridge interfaces disposed within the CEW bay.

In various embodiments, each discharge rail in a pair of discharge rails may be separated by a distance along a forward facing surface of the shield body. For example, a first discharge rail and a second discharge rail in a first pair may be separated by a first distance. A third discharge rail and a fourth discharge rail of a second pair may be separated by a second distance. Further, the first pair of discharge rails may be separated by the second pair of discharge rails by a third distance. In some embodiments, the first distance and the second distance may be substantially similar or the same. In some embodiments, the first distance may be greater than the second distance, or the second distance may be greater than the first distance. In some embodiments, the third distance may be greater than each of the first distance and the second distance. In other embodiments, the third distance may be less than one or both of the first distance and the second distance. In other embodiments, the third distance may be substantially similar or the same as each of the first distance and the second distance.

In various embodiments, a distance between each discharge rail in a pair of discharge rails may be configured to increase a likelihood that an electrical current provided between the pair of discharge rails will cause neuromuscular incapacitation ("NMI") to a target in contact with the pair. The likelihood that an electrical current will cause NMI increases in response to the discharge rails delivering the electrical current being separated by a distance of at least 6 inches (15.24 centimeters) so that the electrical current flows through the at least 6 inches of the target's tissue. In various embodiments, the discharge rails preferably should be separated by a distance of at least 12 inches (30.48 centimeters). In various embodiments, discharge rails of a pair of discharge rails may be separated by any suitable distance configured to cause NMI in a target such as, for example, about 6 inches (15.24 centimeters) to about 12 inches (30.48 centimeters), about 8 inches (20.32 centimeters) to about 11 inches (27.94), greater than about 12 inches (30.48 centimeters), and/or the like (wherein "about" as used in this context refers only to +/−0.5 inches (1.27 centimeters)).

In various embodiments, discharge rails in a pair of discharge rails may be disposed on a forward facing surface of a shield body at any suitable or desired orientation. For example, a pair of discharge rails may be disposed parallel to each other (e.g., a first discharge rail is disposed parallel to a second discharge rail). A pair of discharge rails may be oriented perpendicular to a height of the shield body (e.g., a first discharge rail and a second discharge rail are each oriented perpendicular to the height of the shield body). As a further example, a pair of discharge rails may be disposed horizontally on a shield body. A pair of discharge rails may be disposed vertically on a shield body. A pair of discharge rails may each extend in a same direction.

With particular reference now to FIGS. 2 and 8-11, in various embodiments the discharge rails 104, 106, 110, 112 may be configured to provide an electrical current through an object. The discharge rails 104, 106, 110, 112 may comprise any suitable object or device for conducting an electrical discharge to an object that comes into contact with the front of the shield body 102 such as electrodes, metal bars, rods, electrical wiring, or other conductive material.

For example, in one embodiment the first pair 202 of discharge rails 104, 106 may each comprise a metal band disposed horizontally across a width of an upper portion of the forward facing surface 114 of the shield body 102. When activated, the metal bands may be configured to conduct an electrical current from the first discharge rail 104 through an object and back into the second discharge rail 106 when that object comes into contact with both discharge rails 104, 106 simultaneously. Similarly, the second pair 204 of discharge rails 110, 112 be formed of the same materials as the first pair 202 but may be positioned along a lower portion of the forward facing surface 114 of the shield body 102. When activated, the metal bands of the second pair 204 may be configured to conduct an electrical current from the first discharge rail 110 through an object and back into the second discharge rail 112 when that object comes into contact with both discharge rails 110, 112 simultaneously.

The two pairs 202, 204 of discharge rails may be configured to be activated in unison or they may be independently activated. In one embodiment, each pair 202, 204 may be configured to conduct the electrical current from the first discharge rail 104, 110 to the second discharge rail 106, 112 if contact occurs on one or both pairs of discharge rails 104, 106, 110, 112. For example, the first pair 202 of discharge rails 104, 106 may only conduct a current when simultaneous contact is made between the two corresponding discharge rails 104, 106 and the second pair 204 of discharge rails 110, 112 may only conduct a current when simultaneous contact is made between the two corresponding discharge rails 110, 112. Accordingly, each pair of discharge rails 202, 204 may simultaneously conduct current if contact is being made between both discharge rails of a given pair. As a further example, in some embodiments a first discharge rail from the first pair 202 may conduct a current with a second discharge rail from the second pair 204 in response to an object (e.g., target) contacting the first discharge rail of the first pair 202 and the second discharge rail of the second pair 204.

The discharge rails 104, 106, 110, 112 may be electrically coupled to the CEW bay 308 to create an electric path between the CEW and the discharge rails 104, 106, 110, 112. For example, in response to a target contacting both of the first discharge rail 104 and the second discharge rail 106 of the first pair 202, a circuit is formed between the CEW, the CEW bay 308, the first discharge rail, the second discharge rail, and the target. As a further example, in response to a target contacting both of the third discharge rail 110 and the fourth discharge rail 112 of the second pair 204, a circuit is formed between the CEW, the CEW bay 308, the third discharge rail, the fourth discharge rail, and the target. As a further example, in some embodiments in response to a target contacting at least one of the first discharge rail 106 and the second discharge rail 106 of the first pair 202 and at least one of the third discharge rail 110 and the fourth discharge rail 112 of the second pair 204, a circuit is formed between the CEW, the CEW bay, the at least one of the first discharge rail and the second discharge rail of the first pair, the at least one of the third discharge rail and the fourth discharge rail of the second pair, and the target. In that regard, a circuit may be formed between the first pair of discharge rails and the second pair of discharge rails (e.g., cross connect between different pairs of discharge rails).

With reference now to FIGS. 6, 7, 10, and 11, a central spine 602 may be used to form an electrical circuit between the CEW bay 308, an activation button 306, and/or the discharge rails 104, 106, 110, 112. The central spine 602 may comprise any suitable object or device for providing a path for the circuit, such as a conduit for electrical wiring.

In various embodiments, the central spine 602 may extend along a surface of the rear facing surface 302 of the shield body 102. In an alternative embodiment, the central spine 602 may be disposed inside the shield body 102. Disposing the central spine 602 within the shield body 102 may provide additional protection against damage that might interrupt the electrical circuit.

The arc display device 108 may be configured to provide a visual indicator to the existence of an electrical charge. For example, the arc display device 108 may be configured to receive an electrical current having a high voltage. The high voltage impressed across the arc display device 108 may result in ionization of the air in a gap of the arc display device 108. The ionization of the air may visually form an arc visible to the naked eye. This visual indicator may be useful as a warning to a person in close proximity to the forward facing surface 114 of the shield body 102. This visual indicator may also create pain compliance in response to a target coming in contact with the arc. The arc display device 108 may encourage a person to avoid contact with and create more space between the person and the forward facing surface 114 shield body 102. The arc display device 108 may also be located at any desired location on the shield body 102.

The arc display device 108 may comprise any component or device for generating an electrical arc. In some embodiments, an arc display device may be integrated into (e.g., formed between, monolithic with, etc.) a pair of discharge rails. In other embodiments, an arc display device may comprise one or more separate components from a pair of discharge rails.

Referring now to FIGS. 1, 2, 8, and 9, in one embodiment, a first arc display device 108 may be positioned between the first and second discharge rails 104, 106 of the first pair 202 of discharge rails. A first leg 206 may extend downwardly from the first discharge rail 104 and a second leg 208 may extend upwardly from the second discharge rail 106. For example, in some embodiments the first leg 206 may extend from a center portion of the first discharge rail 104 in a direction towards the second discharge rail 106. The second leg 208 may extend from a center portion of the second discharge rail 106 in a direction towards the first discharge rail 104. The first leg 206 and the second leg 208 may extend from each respective discharge rail towards each other. The first leg 206 and the second leg 208 may be separated from each other by a gap. The gap may be selected (e.g., sized and shaped) such that an arc between the ends of the two legs 206, 208 is created when the arc display device 108 is activated and current flows between the two legs 206, 208.

A second arc display device 210 may be located between the first and second discharge rails 110, 112 of the second pair 204 of discharge rails. As described above, a pair of legs 212, 214 may extend between the first and second discharge rails 110, 112. A first leg 212 may extend downwardly from the first discharge rail 110 and a second leg 214 may extend upwardly from the second discharge rail 112. For example, in some embodiments the first leg 212 may extend from a center portion of the third discharge rail 110 in a direction towards the fourth discharge rail 112. The second leg 214 may extend from a center portion of the fourth discharge rail 112 in a direction towards the third discharge rail 110. The first leg 212 and the second leg 214 may extend from each respective discharge rail towards each other. The first leg 212 and the second leg 214 may be separated from each other by a gap. The gap may be selected such that an arc between the ends of the two legs 212, 214 is created when the arc display device 210 is activated and current flows between the two legs 212, 214.

In some embodiments, the first and second arc display devices 108, 210 may be configured to be activated separate from their corresponding discharge rails 104, 106, 110, 112. For example, a separate activation switch or button 306 may be used to activate one or both arc display devices 108, 210 without also activating the discharge rails 104, 106, 110, 112 (e.g., a first activation switch activates the discharge rails, a second activation switch activates the arc display devices). This may allow a user to provide a warning without having to activate the discharge rails 104, 106, 110, 112.

In some embodiments, the first and second arc display devices 108, 210 may be configured to be activated together with their corresponding discharge rails 104, 106, 110, 112. For example, activation of a single activation switch or button may activate one or both arc display devices 108, 210 and one or both corresponding pairs of discharges rails 104, 106, 110, 112.

In other embodiments, the first arc display device 108 may be configured to be activated together with its corresponding discharge rails 104, 106. The second arc display device 210 may be configured to be activated together with its corresponding discharge rails 110, 112. For example, a first activation switch may activate the first arc display device 108 and its corresponding discharge rail 104, 106. A second activation switch may activate the second arc display device 210 and its corresponding discharge rails 110, 112.

Referring now to FIGS. 3-7, the pair of handles 304 allow a user to carry and position the conducted energy shield 100 during use. In one embodiment, the pair of handles 304 may extend outwardly from the rear surface 302 of the shield body 102 and comprise any suitable size and shape. For example, the handle 304 may comprise a metal C-shaped or U-shaped bar connected to the rear surface of the shield body 102 on each end. Each handle 304 may also be insulated, padded, or covered in a material to improve comfort and grip. Alternatively, one or both handles 304 may also comprise a contoured center portion configured to provide a more ergonomic surface for gripping.

In various embodiments, the pair of handles 304 may be sized and shaped to be received onto a forearm of a user. For example, in response to the shield body 102 comprising an arm guard, the pair of handles 304 may be configured to allow the user to affix the shield body 102 onto the forearm of the user. In that respect, the pair of handles 304 in some embodiments may comprise a pair of straps or other elastic attaching means configured to compress the shield body 102 against the forearm of the user.

The trigger or activation button 306 may be positioned on at least one handle 304 to allow the user to controllably activate and deactivate the flow of electricity from the CEW bay 308 to the discharge rails 104, 106, 110, 112. The activation button 306 may also be configured to activate one or both pairs 202, 204 of discharge rails or a second activation button (not shown) may be used.

To controllably activate and deactivate one or more discharge rails, the trigger or activation button 306 may be electrically coupled to a CEW bay. The trigger or activation button 306 may provide a control signal between the CEW bay (e.g., CEW bay 308). The control signal may indicate the activation or deactivation of trigger or activation button 306. The CEW bay may be further coupled to a CEW. The CEW may detect the activation or deactivation of trigger or activation button 306 in accordance with the control signal coupled to the CEW via the CEW bay. Responsive to detecting the activation or deactivation, the CEW may provide an output signal to conducted energy shield 100. For example, and responsive to detecting a control signal indicating activation of trigger or activation button 306, the CEW may activate the one or more discharge rails by generating a stimulus signal and outputting the stimulus signal via the CEW bay to the one or more discharge rails.

In various embodiments, the trigger or activation button 306 may be positioned in any suitable location. For example, the trigger or activation button 306 may be positioned on a rear facing surface of the shield body 102. The trigger or activation button 306 may be positioned on a CEW bay 308. The trigger or activation button 306 may comprise a physically separate structure configured to be held in a hand of a user.

In various embodiments, and as previously discussed, a conducted energy shield may comprise a plurality of triggers or activation buttons. Each trigger or activation button may be configured to initiate or control different operations. For example, a first trigger or activation button may be configured to activate a first pair of discharge rails and/or a first arc display device. A second trigger or activation button may be configured to activate a second pair of discharge rails and/or a second arc display device. As a further example, a first trigger or activation button may be configured to activate a first pair of discharge rails and/or a second pair of discharge rails. A second trigger or activation button may be configured to activate a first arc display device and/or a second arc display device.

In various embodiments, one or more triggers may be integrated within one or more discharge rails. For example, a trigger may comprise a pressure sensor or switch configured to active in response to a contact or a threshold of contact. The pressure sensor or switch may be integrated into one or more discharge rails such that contact or a threshold of contact against the one or more discharge rails causes activation of the one or more discharge rails.

Referring now to FIGS. 3, 6, 7, and 10-14, the CEW bay 308 is configured to receive and securely hold a CEW 310 during use. For example, the CEW bay 308 may comprise one or more mechanical features configured to allow the CEW 310 to releasably couple to the CEW bay 308. The CEW bay 308 may comprise any system or device for electrically coupling a CEW 310 to the shield body 102 to allow the conducted energy shield 100 to be powered by the CEW 310 during use (e.g., the CEW bay may be configured to provide an electrical current generated by the CEW 310 to the shield body 102). The CEW bay 308 may be electrically coupled to one or more discharge rails, and configured to provide electrical current for the CEW 310 to the one or more discharge rails.

In various embodiments, the CEW bay 308 may be disposed on the shield body 102. For example, the CEW bay 308 may be coupled to a rear facing surface of the shield body 102. The CEW bay 308 may be disposed along the rear facing surface proximate the handle 304. The CEW bay 308 may be disposed along the rear facing surface between the pair of handles 304.

In various embodiments, the CEW bay 308 may be disposed separately from the shield body 102. The CEW bay 308 may be disposed on the user operating the conducted energy shield 100. For example, the CEW bay 308 may be coupled to a utility belt of the user, or otherwise disposed on or coupled to an article of wear of the user. In some embodiments, the CEW bay 308 may comprise a holster coupled to a utility belt of the user. An electrical circuit between the holster and the conducted energy shield 100 may provide electrical coupling from the CEW 310 to the shield body 102. For example, an electrical circuit may travel from the holster, through the utility belt, and to the shield body 102. In some embodiments, a removably electrical connection may exist between the shield body 102 and the utility belt. In that regard, a user may removably connect the utility belt to the shield body 102 between uses.

The CEW bay 308 may comprise one or more cartridge insertion devices 1302 (e.g., cartridge interfaces) disposed within the CEW bay 308. The cartridge insertion device 1302 may be configured to electrically (and/or electronically) coupled the CEW 310 to the CEW bay 308. The cartridge insertion device 1302 may be sized, shaped, and configured to be received into a receiving bay 1202 (e.g., a cartridge bay) of the CEW 310.

In one embodiment, the CEW bay 308 may comprise a cartridge insertion device 1302 configured to replicate the size and shape of a standard deployable cartridge 1204 that is inserted into a receiving bay 1202 of the CEW 310. In another embodiment, the cartridge insertion device 1302 may be configured as a dual cartridge system found in some types of CEWs that have a receiving bay 1202 configured to hold two cartridges 1204. For example, the CEW bay 308 may comprise a single cartridge insertion device 1302 configured to be received into multiple receiving bays 1202 of the CEW 310. As a further example, the CEW bay 308 may comprise a plurality of cartridge insertion devices 1302, with each cartridge insertion device 1302 configured to be received into a single receiving bay 1201 of the CEW 310. In other embodiments, a CEW bay 308 may comprise a quantity of cartridge insertion devices 1302 based on the capabilities of a CEW the CEW bay 308 is configured to receive.

For example, in some embodiments, a cartridge insertion device 1302 conforming to a dual cartridge 1204 format may be configured such that a first cartridge portion (not shown) is electrically connected to a first receiving bay of the CEW 301 and provides power (e.g., electrical signals, a first electrical signal, etc.) to the first pair 202 of discharge rails and a second cartridge portion is electrically connected to a second bay of the CEW 301 to provide power (e.g., electrical signals, a second electrical signal, etc.) to the second pair 204 of discharge rails. A single activation button 306 may simultaneously activate both cartridge portions during use, or separate activation buttons 306 may be used to activate each cartridge portion individually. Alternately or additionally, one or both of the cartridge portions may be configured to receive a control signal from trigger or activation button 306 during use.

The cartridge insertion device 1302 may be adapted to communicate (e.g., inform) to the CEW 310 that the weapon has been connected to the shield body 102 rather than a standard cartridge 1204. For example, circuitry within the cartridge insertion device 1302 may contain an identifier that signals the CEW 310 that it has been inserted into the CEW bay 308. This signal may cause the CEW 310 to enter into a different operational mode that is consistent with the requirements of the conducted energy shield 100. In various embodiments, the identifier may comprise passive and/or active identification means.

The CEW bay 308 may also be configured to control how the electrical current is delivered to the discharge rails 104, 106, 110, 112. For example, in some embodiments, the CEW bay 308 may be configured to release the current in 5 second burst cycles in response to an object coming into contact with at least one of the pairs 202, 204 of discharge rails.

In various embodiments, a holder (not shown) for a standard cartridge 1204 (e.g., a cartridge holder) may be disposed on the rear facing surface 302 of the shield body 102. The cartridge holder may be configured to house a standard cartridge of the CEW 310. For example, the cartridge holder may be configured to allow a user to disengage the CEW 310 from the CEW bay 308 and then insert into the cartridge holder to load a standard cartridge 1204 back into the receiving bay 1202 of the CEW 310. This may allow a user to quickly switch from using the conducted energy shield 100 to using the CEW 310 in a more traditional manner without having to grab a cartridge 1204 from a utility belt or other device for storing cartridges 1204. Similarly, the cartridge holder may be configured to allow the user to insert the CEW 310 to disengage a standard cartridge 1204 so that the CEW 310 can be quickly inserted into the CEW bay 308 to power the conducted energy shield 100.

In various embodiments, a power source (not shown) may be coupled to the rear facing surface 302. The power source may be electrically coupled to the CEW bay 308. The power source may comprise any battery, power supply, or the like disclosed herein. The power source may be configured to supply power to the CEW 310 in response to the CEW 310 being received into the CEW bay 308. For example, the power source may be configured to recharge or provide power to a battery or power supply of the CEW 310.

Systems, methods, and apparatuses may be used to interfere with voluntary locomotion (e.g., walking, running, moving, etc.) of a target. For example, a CEW or conducted electrical shield may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a deployment unit (e.g., cartridge). The terminals are spaced apart from each other. In response to the electrodes of the deployment unit in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more deployment units. The handle may include one or more bays for receiving the deployment units. Each deployment unit may be removably positioned in (e.g., inserted into, coupled to, etc.) a bay. Each deployment unit may releasably electrically, electronically, and/or mechanically couple to a bay. A deployment of the CEW may launch one or more electrodes toward a target to remotely deliver the stimulus signal through the target.

In various embodiments, a deployment unit may include two or more electrodes that are launched at the same time. In various embodiments, a deployment unit may include two or more electrodes that may be launched individually at separate times. Launching the electrodes may be referred to as activating (e.g., firing) a deployment unit. After use (e.g., activation, firing), a deployment unit may be removed from the bay and replaced with an unused (e.g., not fired, not activated) deployment unit to permit launch of additional electrodes.

In various embodiments, a CEW may comprise a handle and one or more deployment units (e.g., cartridges). A handle may be configured to house various components of the CEW that are configured to enable deployment of deployment units, provide an electrical current to deployment units, and otherwise aid in the operation of the CEW. A handle may comprise a handle end opposite a deployment end. The deployment end may be configured, and sized and shaped, to receive one or more deployment units. The handle end may be sized and shaped to be held in a hand of a user. For example, the handle end may be shaped as a handle to enable hand-operation of the CEW by a user. In various embodiments, the handle end may also comprise contours shaped to fit the hand of a user, for example, an ergonomic grip. The handle end may include a surface coating, such as, for example, a non-slip surface, a grip pad, a rubber texture, and/or the like. As a further example, the handle end may be wrapped in leather, a colored print, and/or any other suitable material, as desired.

In various embodiments, a handle may comprise various mechanical, electronic, and/or electrical components configured to aid in performing the functions of the CEW. For example, a handle may comprise one or more triggers, control interfaces, processing circuits, power supplies, and/or signal generators. A handle may include a trigger guard. The trigger guard may define an opening formed in the handle. The trigger guard may be located on a center region of the handle, and/or in any other suitable location on the handle. The trigger may be disposed within the trigger guard. The trigger guard may be configured to protect the trigger from unintentional physical contact (e.g., an unintentional activation of the trigger). The trigger guard may surround the trigger within the handle.

In various embodiments, a trigger be coupled to an outer surface of the handle, and may be configured to move, slide, rotate, or otherwise become physically depressed or moved upon application of physical contact. For example, a trigger may be actuated by physical contact applied to the trigger from within a trigger guard. A trigger may comprise a mechanical or electromechanical switch, button, trigger, or the like. For example, the trigger may comprise a switch, a pushbutton, and/or any other suitable type of trigger. The trigger may be mechanically and/or electronically coupled to a processing circuit. In response to the trigger being activated (e.g., depressed, pushed, etc. by the user), the processing circuit may enable deployment of one or more deployment units from the CEW, as discussed further herein.

In various embodiments, a power supply may be configured to provide power to various components of the CEW. For example, the power supply may provide energy for operating the electronic and/or electrical components (e.g., parts, subsystems, circuits, etc.) of the CEW and/or one or more deployment units. The power supply may provide electrical power. Providing electrical power may include providing a current at a voltage. The power supply may be electrically coupled to a processing circuit and/or a signal generator. For example, a power supply (not shown) may be coupled to processing circuit 1402 and signal generator 1404 with brief reference to FIG. 14. In various embodiments, in response to a control interface comprising electronic properties and/or components, the power supply may be electrically coupled to the control interface. In various embodiments, in response to a trigger comprising electronic properties or components, the power supply may be electrically coupled to the trigger. The power supply may provide an electrical current at a voltage. Electrical power from the power supply may be provided as a direct current ("DC"). Electrical power from the power supply may be provided as an alternating current ("AC"). The power supply may include a battery. The energy of the power supply may be renewable or exhaustible, and/or replaceable. For example, the power supply may comprise one or more rechargeable or disposable batteries. In various embodiments, the energy from the power supply may be converted from one form (e.g., electrical, magnetic, thermal) to another form to perform the functions of a system.

A power supply may provide energy for performing the functions of the CEW. For example, the power supply may provide the electrical current to a signal generator that is provided through a target to impede locomotion of the target (e.g., via a deployment unit). The power supply may provide the energy for a stimulus signal. The power supply may provide the energy for other signals, including an ignition signal and/or an integration signal, as discussed further herein.

In various embodiments, a processing circuit (e.g., processing circuit 1402) may comprise any circuitry, electrical components, electronic components, software, and/or the like configured to perform various operations and functions discussed herein. For example, a processing circuit may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, a processing circuit may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, a processing circuit may include data buses, output ports, input ports, timers, memory, arithmetic units, and/or the like.

A processing circuit may be configured to provide and/or receive electrical signals whether digital and/or analog in form. A processing circuit may provide and/or receive digital information via a data bus using any protocol. A processing circuit may receive information, manipulate the received information, and provide the manipulated information. A processing circuit may store information and retrieve stored information. Information received, stored, and/or manipulated by a processing circuit may be used to perform a function, control a function, and/or to perform an operation or execute a stored program.

A processing circuit may control the operation and/or function of other circuits and/or components of the CEW. A processing circuit may receive status information regarding the operation of other components, perform calculations with respect to the status information, and provide commands (e.g., instructions) to one or more other components. A processing circuit may command another component to start operation, continue operation, alter operation, suspend operation, cease operation, or the like. Commands and/or status may be communicated between a processing circuit and other circuits and/or components via any type of bus (e.g., SPI bus) including any type of data/address bus.

In various embodiments, a processing circuit may be mechanically and/or electronically coupled to a trigger. The processing circuit may be configured to detect an activation, actuation, depression, input, etc. (collectively, an "activation event") of the trigger. In response to detecting the activation event, the processing circuit may be configured to perform various operations and/or functions, as discussed further herein. The processing circuit may also include a sensor (e.g., a trigger sensor) attached to the trigger and configured to detect an activation event of the trigger. The sensor may comprise any suitable sensor, such as a mechanical and/or electronic sensor capable of detecting an activation event in the trigger and reporting the activation event to the processing circuit.

In various embodiments, a processing circuit may be mechanically and/or electronically coupled to a control interface. The processing circuit may be configured to detect an activation, actuation, depression, input, etc. (collectively, a "control event") of the control interface. In response to detecting the control event, the processing circuit may be configured to perform various operations and/or functions, as discussed further herein. The processing circuit may also include a sensor (e.g., a control sensor) attached to the control interface and configured to detect a control event of the control interface. The sensor may comprise any suitable mechanical and/or electronic sensor capable of detecting a control event in the control interface and reporting the control event to the processing circuit.

In some embodiments, a processing circuit may be mechanically and/or electronically coupled to a control interface disposed on another device separate from the CEW. The other device may be selectively coupled to the CEW. The other device may comprise an accessory device. For example, processing circuit 1402 may be electrically coupled to trigger or activation button 306 disposed on conducted energy shield 100. CEW 310 may be physically separable from conducted energy shield 100 such that processing circuit 1402 is electrically coupled to trigger or activation button 306 when CEW 310 is mechanically coupled to conducted energy shield 100 (e.g., via bay 308). Processing circuit 1402 may be disposed in communication with trigger or activation button 306 selectively in accordance with a relative position between CEW 310 and conducted energy shield 100.

In some embodiments, a processing circuit may be mechanically and/or electronically coupled to a control interface via a bay of the CEW. For example, processing circuit 1402 may be electronically coupled to trigger or activation button 306 via receiving bay 1202. A control signal may be provided (e.g., received and/or transmitted) between processing circuit 1404 and trigger or activation button 306 via receiving bay 1202. Receiving bay 1202 may comprise one or more electrical contacts (not shown) configured to electrically couple processing circuit 1402 and trigger or activation button 306. The electrical contacts of receiving bay 1202 may be same or different contacts by which CEW 1310 may be electrically coupled to a cartridge (e.g., 1204) when the cartridge is received in receiving bay 1202 instead of a portion of conducted energy shield 100. The portion of conducted energy shield 100, such as CEW bay 308 or insertion device 1302, may comprise one or more complementary electrical contacts configured to couple to the one or more electrical contacts of receiving bay 1202.

In some embodiments, a processing circuit may be selectively coupled to an accessory device via a receiving bay of a CEW. For example, receiving bay 1202 may be electrically coupled to trigger or activation button 306 when CEW 310 is mechanically coupled to conducted energy shield 100. Receiving bay 1202 may be electrically coupled to trigger or activation button 306 when deployment unit (e.g, deployment unit 1204) is removed (e.g., not coupled) to receiving bay 1202. Processing circuit 1402 may be coupled to a cartridge, different from the accessory device, when the cartridge is received in the receiving bay instead of a portion of conducted energy shield 100. Accordingly, a same receiving bay of a CEW (e.g., receiving bay 1202 of CEW 310) may be configured to both provide a stimulus signal via a cartridge (e.g., cartridge 1204) and receive a control signal from an accessory device (e.g., conducted energy shield 100). The CEW may provide the stimulus signal to the cartridge in accordance with the CEW entering a first mode (e.g., mode of operation) of the CEW. The cartridge may be received in receiving bay 1202 in accordance with the first mode of the CEW. The CEW may receive the control signal in accordance with the CEW entering a second mode. A portion of the accessory device may be received in receiving bay 1202 in accordance with the second mode of the CEW. The second mode may comprise an accessory mode of the CEW. In some embodiments, the CEW may be further configured to provide the stimulus signal for the accessory device (e.g., conducted energy shield 100) in the second mode of the CEW. The stimulus signal may be provided via the same bay by which the control signal is received in the second mode of the CEW. Alternately, the CEW may be configured to provide the stimulus signal though another CEW bay in the second mode, different from the CEW bay by which a control interface (e.g., trigger or activation button 306) may be coupled to the CEW. For example, a CEW 1310 may comprise a first bay through which a control interface may be coupled to processing circuit 1402 and a second bay different from the first bay through which at least one of processing circuit 1402 or signal generator 1404 may be coupled to provide an output signal from CEW 1310.

In some embodiments, a processing circuit may detect activation of a control interface via a bay of the CEW. For example, processing circuit 1402 may detect activation of trigger or activation button 306 via receiving bay 1202. Processing circuit 1402 may further detect deactivation of trigger or activation button 306 via receiving bay 1202. The activation of trigger or activation button 306 may provide a mechanical and/or electrical signal through receiving bay 1202 to processing circuit 1402 indicative of the activation and/or deactivation of trigger or activation button 306. Processing circuit 1402 may receive a signal from the trigger or activation button 306 via receiving bay 1202. In accordance with receiving the signal via receiving bay 1202, processing circuit 1402 may detect the activation of trigger or activation button 306.

In some embodiments, a processing circuit may perform one or more operations responsive to activation of a control interface. The one or more operations may comprise selecting a mode of the CEW. The one or more operations may be performed the processing circuit alone or by the processing circuit in combination with another circuit. For example, processing circuit 1402 may be configured to change a mode of CEW 310 in accordance with a detected activation of trigger or activation button 306, detected coupling to circuitry within cartridge insertion device 1302, or detected activation of another control interface (e.g., power button, on-off switch, etc.) coupled to processing circuit 1402. The one or more operations may alternately or additionally comprise providing an output signal. The output signal may comprise a stimulus signal, ignition signal, or a second control signal different from a first control signal responsive to which processing circuit 1402 generated the output signal. For example, processing circuit 1402 may control stimulus signal generator 1404 to provide an output signal comprising a stimulus signal. Processing circuit 1402 may control stimulus signal generator 1404 to increase, decrease, initiate, or terminate a stimulus signal output by signal generator 1404 in accordance with a detected activation of trigger or activation button 306. The one or more operations may alternately or additionally comprise other functions discussed herein, including providing one or more output signals to activate an arc display device of conducted energy shield 100 or providing a second, additional stimulus signal via a second pair of discharge rails as discussed above. Accordingly, and responsive to activation of the control interface, processing circuit 1402 may provide one or more output signals to one or more different components of conducted energy shield 100, cartridge 1204, or other device coupled to CEW 310.

In various embodiments, a processing circuit may be electrically and/or electronically coupled to a power supply. The processing circuit may receive power from the power supply. The power received from the power supply may be used by the processing circuit to receive signals, process signals, and transmit signals to various other components in the CEW. The processing circuit may use power from the power supply to detect an activation event of a trigger, a control event of a control interface, or the like, and generate one or more control signals in response to the detected events. The control signal may be based on the control event and the activation event. The control signal may be an electrical signal.

In various embodiments, a processing circuit may be electrically and/or electronically coupled to a signal generator. For example, processing circuit 1402 may be coupled to signal generator 1404 with brief reference to FIG. 14. The processing circuit may be configured to transmit or provide control signals to the signal generator in response to detecting an activation event of a trigger. Multiple control signals may be provided from the processing circuit to the signal generator in series. In response to receiving the control signal, the signal generator may be configured to perform various functions and/or operations, as discussed further herein.

In various embodiments, a signal generator may be configured to receive one or more control signals from a processing circuit. The signal generator may provide an ignition signal to one or more deployment units based on the control signals. The signal generator may be electrically and/or electronically coupled to a processing circuit and/or one or more deployment units. The signal generator may be electrically coupled to a power supply. The signal generator may use power received from the power supply to generate an ignition signal. For example, the signal generator may receive an electrical signal from the power supply that has first current and voltage values. The signal generator may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. The signal generator may temporarily store power from the power supply and rely on the stored power entirely or in part to provide the ignition signal. The signal generator may also rely on received power from the power supply entirely or in part to provide the ignition signal, without needing to temporarily store power.

A signal generator may be controlled entirely or in part by a processing circuit. For example, signal generator 1404 may be controlled entirely or in part by processing circuit 1404. Signal generator 1404 may be controlled by processing circuit 1402 to generate a signal output by CEW 1310 (e.g., an output signal). For example, the output signal may comprise one or more of an ignition signal, control signal, or a stimulus signal. The output signal may comprise an electrical signal. In various embodiments, a signal generator and a processing circuit may be separate components (e.g., physically distinct and/or logically discrete). A signal generator and a processing circuit may be a single component. For example, a control circuit within the handle may at least include a signal generator and a processing circuit. The control circuit may also include other components and/or arrangements, including those that further integrate corresponding function of these elements into a single component or circuit, as well as those that further separate certain functions into separate components or circuits.

A signal generator may be controlled by the control signals to generate an ignition signal having a predetermined current value or values. For example, the signal generator may include a current source. The control signal may be received by the signal generator to activate the current source at a current value of the current source. An additional control signal may be received to decrease a current of the current source. For example, the signal generator may include a pulse width modification circuit coupled between a current source and an output of the control circuit. A second control signal may be received by the signal generator to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators may alternatively or additionally be employed, including those that apply a voltage over one or more different resistances to generate signals with different currents. In various embodiments, a signal generator may include a high-voltage module configured to deliver an electrical current having a high voltage. In various embodiments, a signal generator may include a low-voltage module configured to deliver an electrical current having a lower voltage, such as, for example, 2,000 volts.

Responsive to receipt of a signal indicating activation of a trigger (e.g., an activation event), a control circuit provides an ignition signal to one or more deployment units. For example, a signal generator may provide an electrical signal as an ignition signal to a deployment unit in response to receiving a control signal from a processing circuit. In various embodiments, the ignition signal may be separate and distinct from a stimulus signal. For example, a stimulus signal in a CEW may be provided to a different circuit within a deployment unit, relative to a circuit to which an ignition signal is provided. The signal generator may be configured to generate a stimulus signal. In various embodiments, a second, separate signal generator, component, or circuit (not shown) within the handle may be configured to generate the stimulus signal. The signal generator may also provide a ground signal path for a deployment unit, thereby completing a circuit for an electrical signal provided to the deployment unit by the signal generator. The ground signal path may also be provided to the deployment unit by other elements in the handle, including a power supply.

In various embodiments, a deployment unit may comprise a propulsion system and a plurality of projectiles, such as, for example, a first projectile and a second projectile. A deployment unit may comprise any suitable or desired number of projectiles, such as, for example two projectiles, three projectiles, nine projectiles, twelve projectiles, eighteen projectiles, and/or any other desired number of projectiles. Further, a handle may be configured to receive any suitable or desired number of deployment units, such as, for example, one deployment unit, two deployment units, three deployment units, etc.

In various embodiments, a propulsion system may be coupled to, or in communication with, each projectile in a deployment unit. In various embodiments, a deployment unit may comprise a plurality of propulsion systems, with each propulsion system coupled to, or in communication with, one or more projectiles. A propulsion system may comprise any device, propellant (e.g., air, gas, etc.), primer, or the like capable of providing a propulsion force in a deployment unit. The propulsion force may include an increase in pressure caused by rapidly expanding gas within an area or chamber. The propulsion force may be applied to projectiles in a deployment unit to cause the deployment of the projectiles. A propulsion system may provide the propulsion force in response to a deployment unit receiving the ignition signal.

In various embodiments, the propulsion force may be directly applied to one or more projectiles. For example, the propulsion force may be provided directly to a first projectile and/or a second projectile. A propulsion system may be in fluid communication with the projectiles to provide the propulsion force. For example, the propulsion force from the propulsion system may travel within a housing or channel of the deployment unit to one or more projectiles. The propulsion force may travel via a manifold in the deployment unit.

In various embodiments, the propulsion force may be provided indirectly to a first projectile and/or a second projectile. For example, the propulsion force may be provided to a secondary source of propellant within the propulsion system. The propulsion force may launch the secondary source of propellant within the propulsion system, causing the secondary source of propellant to release propellant. A force associated with the released propellant may in turn provide a force to the first projectile and/or the second projectile. A force generated by a secondary source of propellant may cause the first projectile and/or the second projectile to be deployed from the deployment unit and the CEW.

In various embodiments, a projectile may comprise any suitable type of projectile. For example, one or more projectiles may be or include an electrode (e.g., an electrode dart). An electrode may include a spear portion configured to pierce or attach proximate a tissue of a target in order to provide a conductive electrical path between the electrode and the tissue, as previously discussed herein. For example, projectiles may each include a respective electrode. Projectiles may be deployed from a deployment unit at the same time or substantially the same time. Projectiles may be launched by a same propulsion force from a common propulsion system. Projectiles may also be launched by one or more propulsion forces received from one or more propulsion systems. A deployment unit may include an internal manifold configured to transfer a propulsion force from a propulsion system to one or more projectiles. As a further example, one or more projectiles disclosed herein may be or include an electrode (e.g., an electrode dart), an entangling projectile (e.g., a tether-based entangling projectile, a net, etc.), a payload projectile (e.g., comprising a liquid or gas substance), or the like.

A control interface may comprise, or be similar to, any control interface disclosed herein. In various embodiments, a control interface may be configured to control selection of firing modes in a CEW. Controlling selection of firing modes may include disabling firing of a CEW (e.g., a safety mode, etc.), enabling firing of the CEW (e.g., an active mode, a firing mode, an escalation mode, etc.), enabling a stimulus signal to be provided to another device (e.g., accessory mode), controlling deployment of deployment units, and/or similar operations, as discussed further herein.

A control interface may be located in any suitable location on or in a handle. For example, a control interface may be coupled to an outer surface of a handle. A control interface may be coupled to an outer surface of a handle proximate a trigger and/or a trigger guard. A control interface may be electrically, mechanically, and/or electronically coupled to a processing circuit. In various embodiments, in response to a control interface comprising electronic properties or components, the control interface may be electrically coupled to a power supply. The control interface may receive power (e.g., electrical current) from the power supply to power the electronic properties or components. Alternately or additionally, the control interface may be disposed on another device separate from the CEW. The other device may be selectively coupled to the CEW.

A control interface may be electronically or mechanically coupled to a trigger. For example, and as discussed further herein, a control interface may function as a safety mechanism. In response to the control interface being set to a "safety mode," a CEW may be unable to launch projectiles from a deployment unit. For example, the control interface may provide a signal (e.g., a control signal) to a processing circuit instructing the processing circuit to disable deployment of deployment units. As a further example, a control interface may electronically or mechanically prohibit a trigger from activating (e.g., prevent or disable a user from depressing the trigger; prevent the trigger from launching a projectile; etc.).

A control interface may comprise any suitable electronic or mechanical component capable of enabling selection of firing modes. The component may enable manual selection of a firing mode from the firing modes. For example, a control interface may comprise a fire mode selector switch, a safety switch, a safety catch, a rotating switch, a selection switch, a selective firing mechanism, and/or any other suitable mechanical control. As a further example, a control interface may comprise a slide, such as a handgun slide, a reciprocating slide, or the like. As a further example, a control interface may comprise a touch screen or similar electronic component.

The safety mode may be configured to prohibit deployment of an electrode or other projectile from a deployment unit. For example, in response to a user selecting the safety mode, the control interface may transmit a safety mode instruction to a processing circuit. In response to receiving the safety mode instruction, the processing circuit may prohibit deployment of a projectile from a deployment unit. The processing circuit may prohibit deployment until a further instruction is received from the control interface (e.g., a firing mode instruction). As previously discussed, a control interface may also, or alternatively, interact with a trigger to prevent activation of the trigger. In various embodiments, the safety mode may also be configured to prohibit provision of a stimulus signal from signal generator, such as, for example, during a local delivery.

The firing mode may be configured to enable deployment of one or more projectiles from a deployment unit. For example, and in accordance with various embodiments, in response to a user selecting the firing mode, the control interface may transmit a firing mode instruction to the processing circuit. In response to receiving the firing mode instruction, the processing circuit may enable deployment of a projectile from the deployment unit. In that regard, in response to the trigger being activated, the processing circuit may cause the deployment of one or more projectiles. The processing circuit may enable deployment until a further instruction is received from the control interface (e.g., a safety mode instruction). As a further example, and in accordance with various embodiments, in response to a user selecting the firing mode, the control interface may also mechanically (or electronically) interact with the trigger to enable activation of the trigger.

The accessory mode may be configured to enable an output signal from the CEW to be provided to an accessory device coupled to the CEW. The output signal may be generated by the CEW. For example, the output signal may be generated by a processing circuit or a signal generator of the CEW. The accessory device may be distinct from a deployment unit. The accessory device may comprise a non-deployable device. The accessory device may be coupled to the CEW via a bay of the CEW. In embodiments, the accessory device may comprise a local stun device. For example, the accessory device may comprise a conducted energy shield. In some embodiments, a deployment unit may not be coupled to the CEW when the output signal is provided by the CEW to the accessory device. The accessory device may be coupled to the CEW when the output signal is provided by the CEW.

In some embodiments, an output signal provided in the accessory mode may be selected to cause the accessory device coupled to the CEW to perform a predetermined operation of the accessory device. For example, the output signal may comprise a stimulus signal. The signal may alternately or additionally exclude an ignition signal. Accordingly, the output signal may comprise an electrical signal different from another electrical signal by which a deployment unit may be activated to provide remote delivery of a stimulus signal. The output signal may alternately or additionally comprise an electrical signal selected to provide an arc display via an accessory device coupled to a CEW. In some embodiments, the accessory mode may further cause the CEW to be configured to detect a control signal via a bay of the CEW.

In some embodiments, a system comprising a CEW and an accessory device configured to be coupled to the CEW may be provided. The accessory device may be mechanically and/or electrically coupled to the CEW via a receiving bay of the CEW. The accessory device may comprise a control interface. A control signal from the control interface may be provided to the CEW. The control signal may originate from the accessory device. The CEW may be configured to enter an accessory mode responsive to being coupled to the accessory device. The CEW may comprise CEW 1310 or another CEW described above. In some embodiments, the accessory device may comprise conducted energy shield 100 as described above. In other embodiments, the accessory device may comprise an electric prod (e.g., a cattle prod, an electrified baton, etc.) or similar device. In various embodiments, the accessory device may comprise an object having a size greater than the CEW (e.g., the dimensions of the accessory device are greater than the dimensions of the CEW, the mass of the accessory device is greater than the mass of the CEW, etc.).

Figure 15:
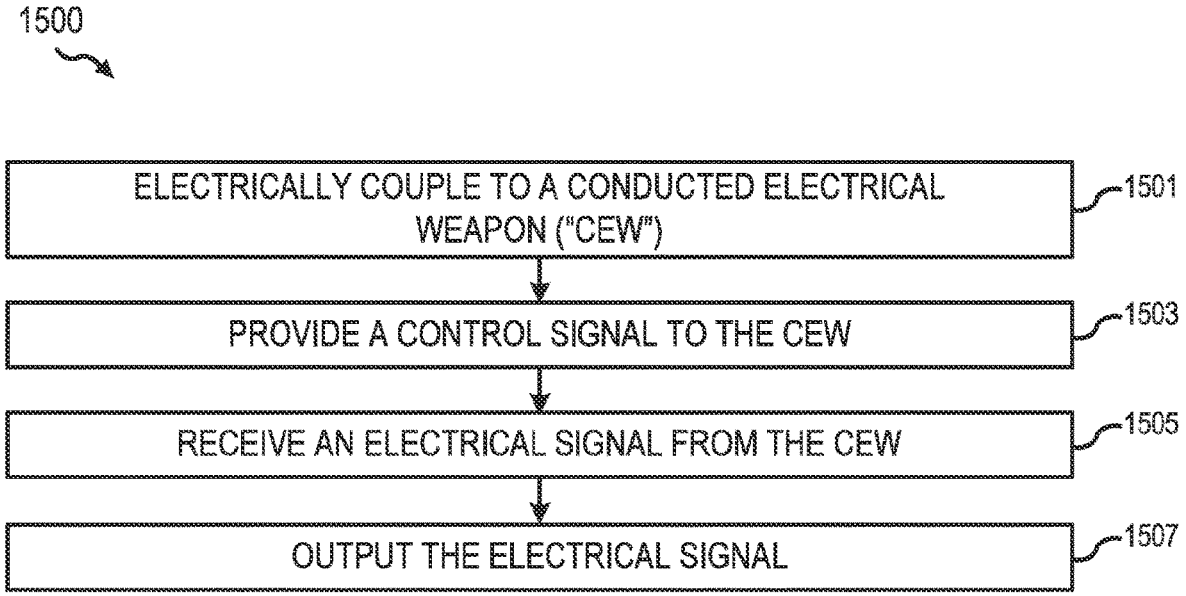
FIG. 15 representatively illustrates a process flow for a method of distributing an electrical current from a conducted electrical weapon in accordance with an exemplary embodiment of the present technology.

In various embodiments, and with reference to FIG. 15, a method 1500 of distributing an electrical current from a conducted electrical weapon ("CEW"). An accessory device may be used to distribute (e.g., provide, output, etc.) the electrical current from the CEW. The accessory device may comprise any accessory device disclosed herein capable of electrically and/or mechanically coupling to a receiving bay of the CEW. For example, the accessory device may comprise an electrified shield (e.g., a conducted energy shield, conducted electrical shield, etc.), an electrified baton, and/or the like. The accessory device may comprise a housing defining a bay (e.g., a CEW bay). The bay may be configured to receive and/or couple to the CEW. The bay may include a cartridge insertion device. The cartridge insertion device may be inserted into a receiving bay of the CEW to couple the accessory device to the CEW. The accessory device may comprise a trigger coupled to the housing. Activation of the trigger may cause a control signal to be transmitted to the CEW. The accessory device may comprise one or more discharge rails coupled to the housing. The one or more discharge rails may be configured to output electrical signals received from the CEW.

In various embodiments, an accessory device may electrically couple to a conducted electrical weapon ("CEW") (step 1501). The accessory device may electrically and/or mechanically couple to the CEW. At least a portion of the accessory device may be inserted into the CEW to couple the accessory device to the CEW. For example, the accessory device may comprise a bay having a cartridge insertion device. The cartridge insertion device may be inserted into a receiving bay of the CEW to electrically and/or mechanically couple the accessory device to the CEW.

In various embodiments, the accessory device may provide a control signal to the CEW (step 1503). The control signal may be generated and/or transmitted response to an input on the accessory device. For example, the accessory device may comprise a trigger, a control interface, and/or the like. Operation and/or input of the trigger, control interface, and/or the like may cause the control signal to be provided to the CEW.

In various embodiments, the accessory device may receive an electrical signal from the CEW (step 1505). Responsive to receiving the control signal, the CEW may generate and provide the electrical signal back to the accessory device. The electrical signal may comprise a stimulus signal generated by a signal generator of the CEW.

In various embodiments, the accessory device may output the electrical signal (step 1507). The accessory device may output the electrical signal in any desired manner of output. For example, the accessory device may comprise electrical terminals, discharge rails, and/or the like configured to output (e.g., provide, discharge, etc.) the electrical signal.

In some embodiments, step 1505 may also include the CEW generating and transmitting a plurality of electrical signals (e.g., a first electrical signal, a second electrical signal, etc.). In that regard, the accessory device may receive the plurality of electrical signals. In some embodiments, step 1507 may comprise outputting the plurality of electrical signals. The plurality of electrical signals may be output for a same electrical terminal, discharge rail, and/or the like. The plurality of electrical signals may be output from different electrical terminals, discharge rails, and/or the like. For example, a first electrical signal may be output from a first electrical terminal, a first discharge rail, and/or the like, and a second electrical signal may be output from a second electrical terminal, a second discharge rail, and/or the like.

In various embodiments, a conducted energy shield is disclosed. The conducted energy shield may comprise a shield body having a forward facing surface and a rear facing surface; a handle disposed along the rear facing surface; a conducted electrical weapon ("CEW") bay disposed along the rear facing surface proximate the handle; a trigger positioned on the handle and electrically coupled to the CEW bay; a spine forming an electrical circuit leading from the CEW bay to the forward facing surface; and a pair of discharge rails disposed along the forward facing surface and coupled to the electrical circuit. The CEW bay may be configured to receive a CEW; and provide an electrical current generated by the CEW. The pair of discharge rails may be configured to provide the electrical current to an object that comes into contact with the pair of rails.

In various embodiments of the above-disclosed conducted energy shield, the pair of discharge rails may be disposed parallel to each other. The pair of discharge rails may be oriented perpendicular to a height of the shield body. The pair of discharge rails may be disposed between about eight and eleven inches apart. The conducted energy shield may further comprise an arc display device. The arc display device may comprise a first leg extending from a first center portion of a first discharge rail towards the opposing second discharge rail; and a second leg extending from a second center portion of a second discharge rail towards the opposing first discharge rail, wherein a gap is created between an end of the first leg and an end of the second leg, and wherein the arc display device is configured to create a visible electrical arc in the gap. The conducted energy shield may further comprise a second pair of rails disposed along the forward facing surface and coupled to the electrical circuit, wherein the second pair of rails may also be configured to provide the electrical current to an object that comes into contact with the second pair of rails. The CEW bay may comprise a cartridge interface configured to fit into a cartridge bay of the CEW. The cartridge interface may be configured to mate to the CEW having a double cartridge bay. The cartridge interface may be programmed to inform the CEW that it is holstered in the CEW bay. The CEW bay may be configured to provide the electrical current in five second bursts.

In various embodiments, a conducted energy shield may comprise a shield body having a forward facing surface and a rear facing surface; a discharge rail disposed along the forward facing surface; and a conducted electrical weapon ("CEW") bay electrically coupled to the discharge rail, wherein the CEW bay is configured to removably receive a CEW, and wherein the CEW bay is configured to provide an electrical current from the CEW to the discharge rail.

In various embodiments of the above-disclosed conducted energy shield, the CEW bay may be coupled to the rear facing surface of the shield body. The conducted energy shield may further comprise an electrical circuit configured to electrically couple the discharge rail to the CEW bay, wherein the discharge rail may be coupled to the forward facing surface of the shield body, and wherein the electrical circuit may be disposed within the shield body. The CEW bay may comprise a holster. The shield body may comprise a concave shape. The shield body may comprise a convex shape. The shield body may comprise a forearm guard. The discharge rail may comprise a first discharge rail and a second discharge rail, and wherein the first discharge rail and the second discharge rail may be separated by a distance along the forward facing surface. In response to a target contacting both of the first discharge rail and the second discharge rail, a circuit may be formed between the CEW, the CEW bay, the first discharge rail, the second discharge rail, and the target. The discharge rail may comprise a first discharge rail, a second discharge rail, a third discharge rail, and a fourth discharge rail, the first discharge rail and the second discharge rail may be separated by a first distance along the forward facing surface, and the third discharge rail and the fourth discharge rail may be separated by a second distance along the forward facing surface. In response to a target contacting at least one of the first discharge rail and the second discharge rail and at least one of the third discharge rail and the fourth discharge rail a circuit may be formed between the CEW, the CEW bay, the at least one of the first discharge rail and the second discharge rail, the at least one of the third discharge rail and the fourth discharge rail, and the target. The discharge rail may comprise a plurality of discharge rails, and wherein a quantity of the plurality of discharge rails may be based on a number of cartridges the CEW is configured to receive. The conducted energy shield may further comprise a cartridge holder coupled to the rear facing surface of the shield body, wherein the cartridge holder may be configured to house a cartridge for the CEW. The conducted energy shield may further comprise a power source electrically coupled to the CEW bay, wherein the power source may be configured to recharge a battery of the CEW in response to the CEW being received into the CEW bay.

In various embodiments, an electrical system for a conducted electrical shield is disclosed. The electrical system may comprise a conducted electrical weapon ("CEW") bay configured to receive and electrically couple to a CEW; and a cartridge insertion device disposed within the CEW bay, wherein the cartridge insertion device is configured to be inserted within a receiving bay of the CEW in response to the CEW being inserted into the CEW bay, and wherein the cartridge insertion device is configured to electrically couple the CEW bay to the CEW.

In various embodiments of the above-described electrical system, the cartridge insertion device may be sized and shaped similar to a standard deployable cartridge capable of being operated by the CEW. The receiving bay of the CEW may comprise a first receiving bay and a second receiving bay, and wherein the cartridge insertion device may be configured to be inserted within both of the first receiving bay and the second receiving bay in response to the CEW being inserted into the CEW bay. The cartridge insertion device may be configured to receive a first electrical signal from the first receiving bay and a second electrical signal from the second receiving bay, and wherein the cartridge insertion device may be configured to provide the first electrical signal to a first discharge rail of the conducted electrical shield and the second electrical signal to a second discharge rail of the conducted electrical shield. The cartridge insertion device may comprise a first cartridge insertion device configured to be inserted within the first receiving bay and a second cartridge insertion device configured to inserted within the second receiving bay.

In various embodiments, a conducted electrical weapon ("CEW") is disclosed. The CEW may comprise: a first receiving bay configured to receive a deployment unit; a signal generator coupled to the first receiving bay; and a processing circuit communicatively coupled to the first receiving bay and the signal generator. The processing circuit may be configured to perform operations comprising: receiving, via the first receiving bay, a control signal from a control interface; and responsive to the control signal, controlling the signal generator to provide an output signal from the CEW.

In various embodiments of the above-described CEW, the output signal may comprise a stimulus signal. The output signal may be provided via the first receiving bay. The CEW may further comprise a second receiving bay communicatively coupled to the processing circuit and the signal generator, wherein the output signal may be provided via the second receiving bay. The control interface may be disposed on another device selectively coupled to the CEW. The control interface may comprise an activation button. The operations may further comprise entering an accessory mode; and responsive to entering the accessory mode, receiving the control signal via the first receiving bay. The operations may further comprise: entering a firing mode; in accordance with entering the firing mode, controlling the signal generator to generate a stimulus signal; and providing the stimulus signal via the first receiving bay to the deployment unit, wherein the stimulus signal is different from the output signal. Controlling the signal generator may comprise controlling the signal generator to generate the output signal when the deployment unit is removed from the bay.

These and other embodiments for methods for a conducted energy shield may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the components and/or elements recited in any apparatus embodiment may be assembled or otherwise operationally configured in a variety of permutations to produce substantially the same result as the present technology and are accordingly not limited to the specific configuration recited in the specific examples.

As used herein, the terms "comprises," "comprising," or any variation thereof, are intended to reference a non-exclusive inclusion, such that a process, method, article, composition, or apparatus that comprises a list of elements does not include only those elements recited but may also include other elements not expressly listed or inherent to such process, method, article, composition, or apparatus. Other combinations and/or modifications of the above-described structures, arrangements, applications, proportions, elements, materials, or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to exemplary embodiments. However, changes and modifications may be made to the exemplary embodiments without departing from the scope of the present technology. These and other changes or modifications are intended to be included within the scope of the present technology, as expressed in the following claims.

What is claimed is:

1. A system comprising:

a conducted electrical weapon ("CEW") comprising a signal generator in electrical communication with a receiving bay; and an accessory device electrically coupled to the receiving bay of the CEW, wherein the accessory device is configured to provide a control signal to the CEW, and wherein in response to receiving the control signal from the accessory device the CEW is configured to provide an electrical current to the accessory device.

2. The system of claim 1, wherein the electrical current comprises a stimulus signal.

3. The system of claim 1, wherein the accessory device comprises a conducted energy shield.

4. The system of claim 1, wherein the accessory device comprises a non-deployable device.

5. The system of claim 1, wherein in response to the CEW being electrically coupled to the accessory device, the CEW is configured to enter an accessory mode.

6. The system of claim 1, wherein the accessory device comprises a trigger, and wherein activation of the trigger causes the accessory device to provide the control signal to the CEW.

7. The system of claim 1, wherein the accessory device comprises a control interface, and wherein activation of the control interface causes the accessory device to provide the control signal to the CEW.

8. The system of claim 7, wherein the control signal enables or disables provision of the electrical current from the CEW.

9. The system of claim 1, wherein the accessory device comprises a cartridge interface configured to be received into the receiving bay of the CEW.

10. The system of claim 9, wherein the cartridge interface is configured to inform the CEW that the CEW is electrically coupled to the accessory device.

11. A method comprising:

providing, by an accessory device, a control signal to a conducted electrical weapon ("CEW"), wherein the accessory device is electrically coupled to a receiving bay of the CEW;

receiving, by the accessory device, an electrical signal from the CEW, wherein the electrical signal is provided responsive to the control signal; and outputting, by the accessory device, the electrical signal.

12. The method of claim 11, further comprising electrically coupling the accessory device to the CEW.

13. The method of claim 12, wherein the accessory device comprises a cartridge interface, and wherein the electrically coupling comprises inserting the cartridge interface into the receiving bay of the CEW.

14. The method of claim 11, wherein the outputting comprises discharging the electrical signal from a discharge rail of the accessory device.

15. The method of claim 11, wherein the electrical signal comprises a stimulus signal.

16. An accessory device for receiving an electrical current from a conducted electrical weapon ("CEW"), the accessory device comprising:

a housing defining a bay, wherein the bay is configured to receive and electrically and mechanically couple to the CEW;

a cartridge insertion device disposed within the bay, wherein the cartridge insertion device is configured to be inserted within a receiving bay of the CEW to electrically couple the bay to the CEW; and a trigger coupled to the housing, wherein an activation of the trigger transmits a control signal to the CEW, and wherein responsive to the control signal the CEW is configured to provide the electrical current to the accessory device.

17. The accessory device of claim 16, further comprising a discharge rail coupled to the housing, wherein the discharge rail is configured to output the electrical current.

18. The accessory device of claim 16, wherein the housing comprises a conducted energy shield having a concave shape.

19. The accessory device of claim 16, further comprising a first discharge rail coupled to the housing at a first location and a second discharge rail coupled to the housing at a second location, wherein the first discharge rail and the second discharge rail are configured to output the electrical current.

20. The accessory device of claim 19, wherein the first discharge rail comprises a first pair of discharge rails, and wherein the second discharge rail comprises a second pair of discharge rails.

* * * * *